US005938281A

United States Patent [19]

Keils

[11] Patent Number: 5,938,281

[45] Date of Patent: Aug. 17, 1999

[54] SEATING STRUCTURE FOR CHILD

[76] Inventor: Ellen M. Keils, 20965 Sunnydale, Farmington Hills, Mich. 48336

[21] Appl. No.: 08/972,378

[22] Filed: Nov. 18, 1997

Related U.S. Application Data

[60] Provisional application No. 60/031,165, Nov. 19, 1996.

[51] Int. Cl.[6] ..... A47C 7/62; A47C 31/12

[52] U.S. Cl. ..... 297/217.1; 297/188.1; 297/118; 297/217.4; 297/485; 312/235.2; 312/235.3; 446/479; 446/482

[58] Field of Search ..... 297/217.1, 118, 297/129, 188.01, 188.08, 188.09, 188.1, 188.13, 217.2, 217.4, 217.5; 368/76; 312/230, 237, 235.2, 235.3; 446/478, 479, 482

[56] References Cited

U.S. PATENT DOCUMENTS

| | | | |
|---|---|---|---|
| 915,442 | 3/1909 | Johnson | 312/235.2 |
| 2,808,170 | 10/1957 | Bernhard | 297/188.1 X |
| 2,936,025 | 5/1960 | Kaufmann | 297/188.1 X |
| 2,963,332 | 12/1960 | Breuning | 312/235.3 X |
| 3,337,983 | 8/1967 | Ebstein | 446/482 |
| 3,592,506 | 7/1971 | Breslow | 297/118 X |
| 4,538,142 | 8/1985 | Hamilton | 297/217.1 X |
| 4,682,827 | 7/1987 | Woodward | 446/482 X |
| 4,992,068 | 2/1991 | Conrad | 446/478 X |
| 5,676,426 | 10/1997 | Herring | 297/485 X |
| 5,683,137 | 11/1997 | Mc Donald et al. | 297/217.4 X |
| 5,706,613 | 1/1998 | Drake, Jr. et al. | 446/482 X |
| 5,718,475 | 2/1998 | Watts | 297/188.1 X |

FOREIGN PATENT DOCUMENTS

| | | | |
|---|---|---|---|
| 1012556 | 7/1952 | France | 446/479 |
| 133178 | 12/1932 | Germany | 446/479 |
| 95615 | 2/1960 | Norway | 312/235.2 |

*Primary Examiner*—Jose V. Chen
*Assistant Examiner*—Rodney B. White

[57] ABSTRACT

A seating structure for a child is provided. The seating structure includes a box open at an upper end. The box includes a bench positioned within the box.

7 Claims, 1 Drawing Sheet

SEATING STRUCTURE FOR CHILD

CROSS-REFERENCE TO RELATED APPLICATION(S)

The present invention claims the priority date of copending U.S. Provisional Patent Application Ser. No. 60/031,165, filed Nov. 19, 1996.

BACKGROUND OF THE INVENTION

1. Field of the Invention

The present invention relates generally to seating structures and, more particularly, to a seating structure for a child.

2. Description of the Related Art

Many parents advocate the use of a "time-out"technique as an effective means of child discipline. For example, if the child misbehaves, the child is removed from the offending situation and required to sit in an isolated location for an appropriate length of time. Many parents believe a time-out is more effective if a consistent location is used for the time-out. Also, for a young child, it may be very difficult to remain seated in a particular location for a period of time. Therefore, there is a need in the art for a time-out seating structure that provides a consistent location and encourages the child to remain seated for a specific period of time.

SUMMARY OF THE INVENTION

It is, therefore, one object of the present invention to provide a seating structure for a child.

It is another object of the present invention to provide a seating structure as a time-out location.

It is yet another object of the present invention to provide a seating structure for a child resembling a penalty box.

It is still another object of the present invention to provide a seating structure that includes a timing mechanism.

It is a further object of the present invention to provide a seating structure including storage space.

To achieve the foregoing objects, the present invention is a seating structure for a child. The seating structure includes a box open at an upper end. The box includes a bench positioned within the box.

One advantage of the present invention is that a new and improved seating structure for a child is provided. Another advantage of the present invention is that the seating structure provides a consistent time-out location. Yet another advantage of the present invention is that the time-out seating structure resembles a sports related penalty box to encourage the child to remain in the time-out location. Still another advantage of the present invention is that the seating structure includes a timing mechanism indicating the period of time the child should remain in a time-out. A further advantage of the present invention is that the seating structure provides storage space for items such as toys.

Other objects, features and advantages of the present invention will be readily appreciated as the same becomes better understood after reading the subsequent description when considered in connection with the accompanying drawings.

DESCRIPTION OF THE PREFERRED EMBODIMENT(S)

Figure 1:
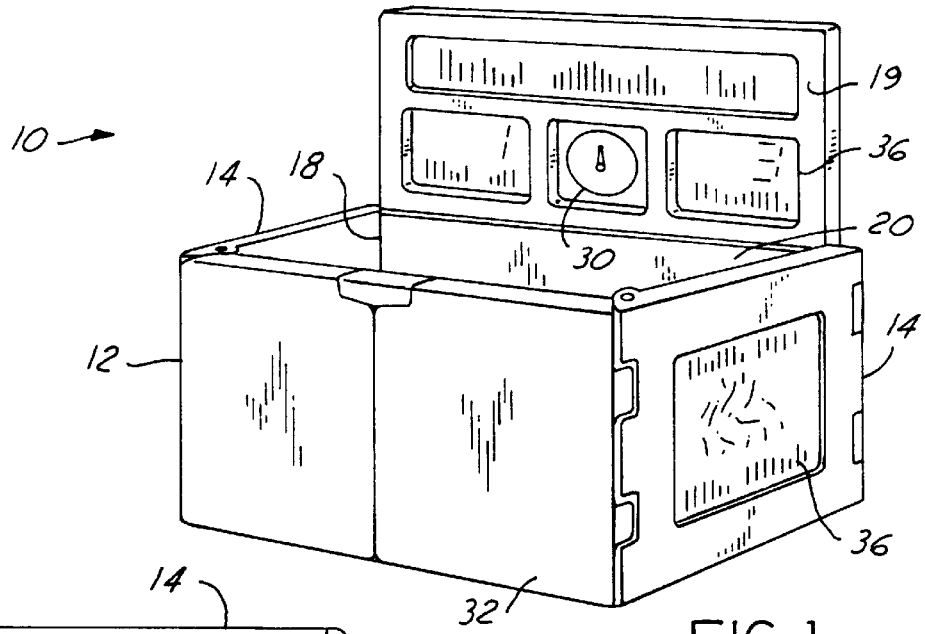
FIG. 1 is a plan view of a seating structure for a child, according to the present invention.
Figure 2:
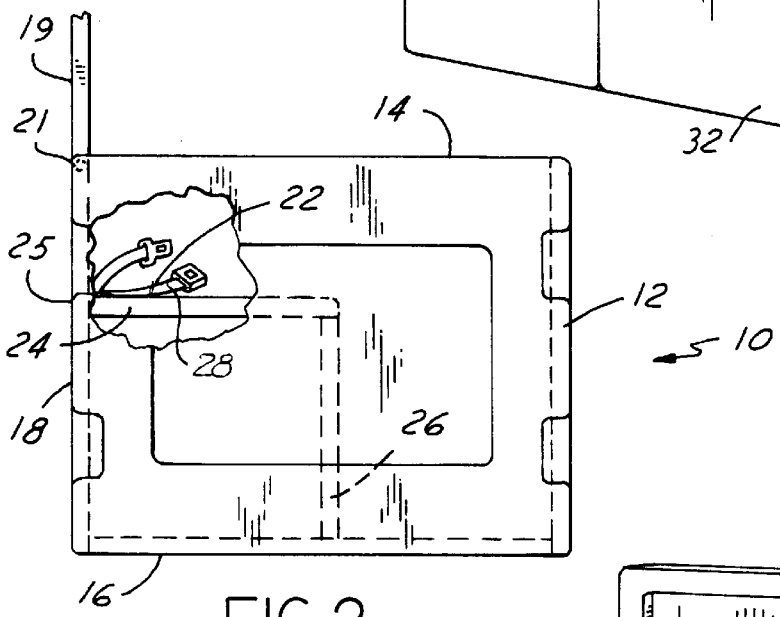
FIG. 2 is a side view of the seating structure, according to the present invention.

Referring to FIG. 1 and FIG. 2, a seating structure for a child, according to the present invention is disclosed. In the preferred embodiment, the seating structure resembles a penalty box 10, such as a penalty box found at an ice hockey arena.

The penalty box 10 includes a generally planar front portion 12, and a generally planar back portion 18 opposing the front portion 12. The penalty box 10 also includes a pair of generally planar opposing side portions 14, each interconnecting the front portion 12 and the back portion 18. The penalty box 10 also includes a generally planar floor portion 16 adjacent a lower end of each one of the front portion 12, the back portion 18 and the side portions 14. It should be appreciated that the front portion 12, side portions 14, floor portion 16 and back portion 18, cooperate together to form a box that is open at an upper end 20.

The size of the penalty box 10 is appropriate for a child to be seated within. For example, the front portion 12 is thirty (30) inches wide and twenty (20) inches high. The side portions 14 are twenty-four (24) inches wide and twenty (20) inches high. The floor portion 16 is thirty (30) inches wide by twenty-four (24) inches deep. The back portion 18 is thirty (30) inches wide and twenty-four (24) inches high.

Optionally, the back portion 18 may include a transversely positioned hinging mechanism 21, so that an upper section of the back portion 18 can fold down into a lid. It should be appreciated that with the lid down, the penalty box 10 can have other uses, such as for storage. In this example, the back portion 18 and upper section 19 together are forty-four (44) inches in height to provide a lid.

The penalty box 10 also includes a bench 22 positioned inside it. It is contemplated that the bench 22 may or may not be removable. Preferably, the bench 22 includes a seating portion 24 and a supporting portion 26. The seating portion 24 is positioned between the side portions 14. Preferably, the supporting portion 26 supports the seating portion 24 and is vertically positioned between the seating portion 24 and the floor portion 16. The size of the bench 22 is likewise dimensioned to accommodate a child. For example, the bench 22 is twelve (12) inches high, thirty (30) inches wide and twelve (12) inches deep. It should be appreciated that the supporting portion 26, floor portion 16 and back portion 18 may cooperate together to form a storage box. The seating portion 24 may include a transversely positioned hinging mechanism 25 for hingedly connecting to the back portion 19 to provide a lid for the storage box.

It should also be appreciated that in this example the penalty box 10 includes a restraining mechanism for keeping a child seated in the penalty box 10. Preferably, the restraining mechanism is a seat belt 28. An end of the restraining mechanism may be secured to the penalty box 10, such as to the bench 22.

The penalty box 10 includes a timing mechanism 30, such as a timer. The timer 30 provides the child with a visual and auditory indicator of the length of the time-out period. Preferably, the timer 30 is disposed on an exterior surface of the penalty box 10, such as the back portion 18.

One method for a child to access the penalty box 10 is by climbing in or out. Another method of access is a door 32 for ingress and egress from the penalty box 10. For example, the front section may be the door 32. The front portion 12 may be divided into two door sections 32. It should be appreciated that one door section 32 may be stationary and the other may be movable. In still another example, a side portion may be the door 32.

The penalty box 10 is constructed from a rigid material, such as plastic. It should be appreciated that exterior angles of the penalty box 10 may include a radius. Preferably, the penalty box 10 includes an indicia 36 that make the penalty box 10 attractive to a child. For example, a sticker placed on a surface of the penalty box may be a replica of a team sport emblem, a scoreboard, or a sport's figure such as a referee.

Figure 3:
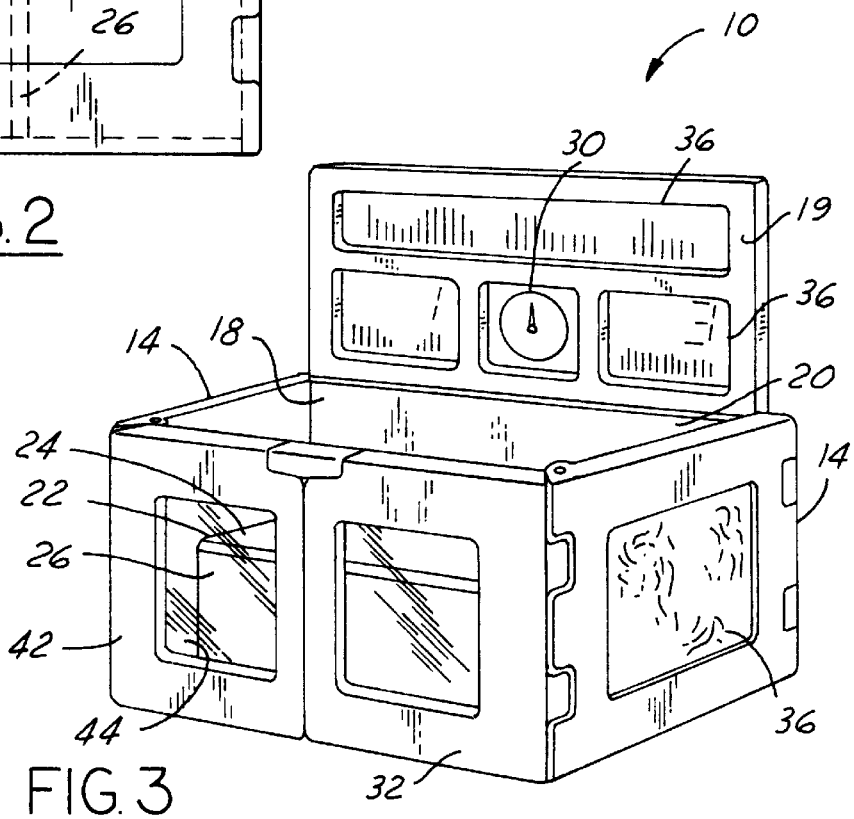
FIG. 3 is a plan view of another embodiment, according to the present invention, of the seating structure for a child.

Referring to FIG. 3, another embodiment, according to the present invention, of a seating structure for a child is illustrated. Like parts of a penalty box 10 have like reference numerals. The front portion 12 includes a frame 42 surrounding a window 44. The frame 42 is a rigid material, such as plastic, and the window 44 is a transparent material, such as plexiglass.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A seating structure for a child comprising:

an open box-shaped housing having a front portion, a back portion, a pair of side portions, a floor portion, and an open top;

said back portion having a first member substantially equal in height to said front and pair of side portions, and having a second member extending vertically above said first member;

a bench member in said housing;

a restraining mechanism attached inside said housing for keeping a child seated on said bench member;

a timing mechanism for indicating a time out; and at least one door member in said front portion.

2. The seating structure of claim 1 wherein said restraining mechanism is a seat belt.

3. The seating structure of claim 1 further comprising a hinge mechanism positioned between said first and second members of said back portion, wherein said second member can be rotated about said hinge mechanism to substantially cover the open top of said box-shaped housing.

4. The seating structure of claim 1 wherein said timing mechanism is positioned on said second member of said back portion.

5. The seating structure of claim 1 wherein said front portion has two of said door members.

6. The seating structure of claim 5 wherein said door members comprise substantially the entire width of said front portion and are hingedly connected to said pair of side portions.

7. The seating structure of claim 1 further comprising sports-related display indicia on at least said pair of side portions.

* * * * *